US005187911A

United States Patent [19]

Cotter

[11] Patent Number: 5,187,911

[45] Date of Patent: Feb. 23, 1993

[54] STANDING SEAM ROOFING/CLADDING SYSTEM

[75] Inventor: Donald P. Cotter, Livermore Falls, Me.

[73] Assignee: Cotterco, Inc., Livermore Falls, Me.

[21] Appl. No.: 685,258

[22] Filed: Apr. 12, 1991

[51] Int. Cl.[5] ..... E04D 1/34; E04D 1/36

[52] U.S. Cl. ..... 52/469; 52/528; 52/537; 52/545; 52/549

[58] Field of Search ..... 52/545, 537, 529, 528, 52/530, 531, 532, 466, 469, 465, 549, 462

[56] References Cited

U.S. PATENT DOCUMENTS

| | | | |
|---|---|---|---|
| 102,441 | 4/1870 | Siddons . | |
| 1,406,980 | 2/1922 | Crawford | 52/545 |
| 1,669,690 | 5/1928 | Brandl | 52/545 |
| 4,001,995 | 1/1977 | Cotter . | |
| 4,400,922 | 8/1983 | Boyer | 52/530 |
| 4,495,743 | 1/1985 | Ellison . | |
| 4,583,339 | 4/1986 | Cotter . | |

FOREIGN PATENT DOCUMENTS

| | | |
|---|---|---|
| 209725 | 2/1956 | Australia . |
| 1934524 | 2/1973 | Fed. Rep. of Germany . |
| 383646 | 3/1908 | France . |

OTHER PUBLICATIONS

SMACNA Architectural Manual, 4th Ed., pp. 153, 241, 245 and 255.

Fabral product brochures, pp. 1, 8, 9 and 12 dated Sep. 1989.

McElroy Metal, Inc. Erection Manual, p. 8, effective Apr. 1, 1987.

"Air Pressure Testing of Sheet Metal Roofing," Richard C. Schroter, Proceedings of the 1985 International Symposium on Roofing Technology.

Reynolds Aluminum Product Brochure "Commercial Roofing and Siding Products," pp. 1, 3-6, 10, 11, Jan. 1976.

*Primary Examiner*—Michael Safavi

*Attorney, Agent, or Firm*—Graham & James

[57] ABSTRACT

A standing seam roofing/cladding system (2) includes elongate pans (4) having first and second lateral edges (6, 8) secured to a support structure (12) by channel brackets (10). The channel brackets each include a base (36) and first and second U-shaped arms (38, 40) defining downwardly opening cavities (42, 44). The lateral edges of the pans each include upwardly extending hems (18, 20), sized and positioned to be housed within the cavities formed by the U-shaped arms. The lateral edges also include generally vertically extending legs (22, 24) extending from the hems. The engagement of the hems within the cavities secures the lateral edges of the pans to the support structure. The upper portions (26, 28; 58, 60) of the legs are mechanically interlocked to form a standing seam (30; 62) thus creating a standing seam joint (45). An optional batten (52) may be used over the standing seam joint if desired.

1 Claim, 2 Drawing Sheets

STANDING SEAM ROOFING/CLADDING SYSTEM

BACKGROUND OF THE INVENTION

Trapezoidal-type standing seam roofing systems were first made with exposed fasteners which pierced the pans. This proved to be unacceptable because of leaks at the penetrations. Also, especially with lengthy pans, thermal expansion and contraction would either cause the fasteners to fail or create elongated holes in the pans, thus creating additional sources of leaks as well as weakening the structure.

To combat these problems, sealed clips were developed. Conventional clips were of two piece construction. The upper portions were folded or interlocked at the uppermost section of the standing seam while the lower section was fastened to the structure. Usually, the two pieces were connected with a slot to allow for thermal movement.

Although the newer designs seemed to address the problems of the exposed, pan-penetrating fasteners, they were still subject to failure, primarily of two types. The first type of failure occurred when the roofing system would pull off from the support structure during negative (uplift) wind conditions. The second type of failure was leaking.

Conventional systems were tested in laboratories using steady-state conditions; such tests did not, however, mimic actual use conditions. Winds are not constant so that uplift forces fluctuate. These fluctuating conditions, which flex the metal back and forth, can work the clip loose or fatigue it to failure. When the uplift conditions are severe, the roofing panel deforms upward in a convex condition; this tends to pull the standing seams and ribs apart. Conventional two piece clips hold standing seam roofing panels near the tops of their joints, thus allowing flexing of the joints. Flexing not only can ruin the weatherproof seal of the standing seam joint, but can also cause the legs of the seam to spread apart (in what is called rib spread) which can lead to disengagement of the clips from the pans and thus failure of the roofing system.

Another cause of clip failure originates at installation. Conventional two part standing seam clips are slidably mounted to one another to accommodate thermal movement. During installation it becomes difficult, if not impossible, to determine what the proper relative positions between the two pieces of the clip should be when installed. That is, should the clips be positioned at one sliding extreme, the other sliding extreme or centered? In practice, the clips are installed centered, even though that may not be the appropriate place. Because of this, the clips may reach their limits of relative movement during the daily thermal expansion and contraction of the pans. Subjecting the clips through this cyclic stress can result in clip or fastener failure.

Another problem with conventional standing seam joints is created by leaks at the terminations of the standing seams, such as at eaves, penetrations, hips, ridges, and so forth. The primary cause of leaks is the inability to seal the end of the standing seam. This is primarily due to its accordion nature. The ends of panels creating the standing seam joint are highly vulnerable to distortion. The open ends of standing seam joints seldom fit the preformed neoprene and metal closures which are designed for use with undamaged, properly shaped standing seam joints. Despite attempts to fill any voids with sealants, leaks often occur through gravity penetration, wind forced penetration and capillary action.

SUMMARY OF THE INVENTION

The present invention is directed to a standing seam roofing/cladding system having a standing seam joint secured to the support structure at the lower portions of the lateral edges of the pans to substantially eliminate forces tending to deform and disengage the standing seam.

The system includes elongate pans having first and second lateral edges secured to a support structure by channel brackets. The channel brackets each include a base and first and second U-shaped arms defining downwardly opening cavities. The lateral edges of the pans each include upwardly extending hems, sized and positioned to be housed within the cavities formed by the U-shaped arms. The lateral edges each include generally vertically extending legs extending from the hems. The engagement of the hems within the cavities secures the lateral edges of the pans to the support structure. The upper portions of the legs are mechanically interlocked to form a standing seam thus creating a standing seam joint. An optional batten may be used over the standing seam joint if desired.

One of the primary advantages of the invention accrues through engaging the lateral edges at the lower portions or base of the lateral edges. Doing so eliminates distortion to the standing seam joint due to external forces, primarily wind loads. Uplift forces have no effect on the standing seam; it cannot unfold due to uplift forces. The sloping legs of the trapezoidal shape of the standing seam as well as the standing seam itself are isolated from negative uplift forces. There can be no metal fatigue since the channel bracket eliminates flexing of the standing seam. The precise fit of neoprene and metal end closures for the joint is also aided.

Another advantage of the invention is that the standing seam joint can be modified by mounting an optional batten over the joint. The batten simply snaps over the joint to cover the joint for both aesthetic and structural advantages. Use of the batten provides substantial additional strength to the joint. Longer spans for the same loads can be used. Less structural strength in the support structure will be needed thus creating additional savings. The addition of a batten to a standing seam joint provides an additional barrier against rain, ice and snow to create a very efficient seam in extreme environments. Further, when a change of direction of the joint, such as at a ridge, fascia or soffit, the batten can be notched and flashed into itself covering the cut standing seam joint to create a smooth transition without a need for patch joints.

In addition, the bracket allows for unlimited thermal movement, not restricted by slots formed in two piece clips, as in conventional standing seam clips.

A further advantage of the invention is that specialized spacer bars, used with conventional standing seam roofing systems to properly space the vertically extending legs forming the seam, are not needed. Since the channel brackets engage the lower portions of the lateral edges, lateral misposition of the brackets is not a problem.

A still further advantage of the invention is that the installer can visually inspect the brackets engaging the proposed legs of the adjacent panels to insure proper installation. This can be accomplished by simply flexing the two legs back away from one another prior to forming the standing seam.

Other features and advantages of the invention will appear from the following description in which the preferred embodiments have been set forth in detail in conjunction with the accompanying drawings.

DESCRIPTION OF THE PREFERRED EMBODIMENT

Figure 1:
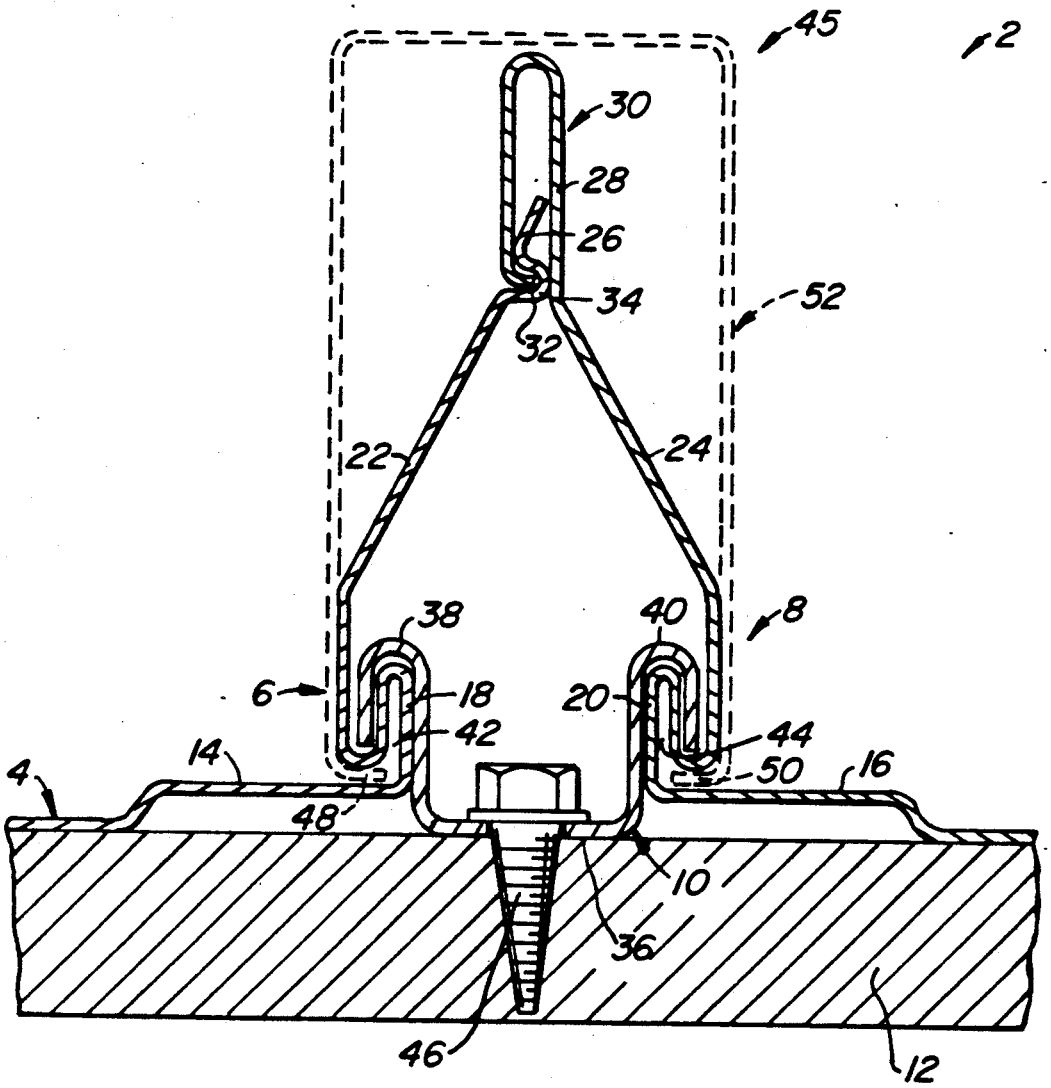
FIG. 1 illustrates an end view of the joint portion of a standing seam roofing/cladding system made according to the invention.
Figure 3:
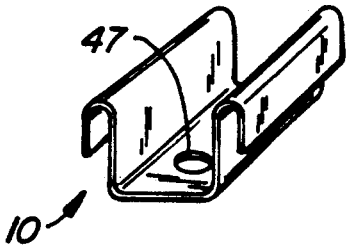
Figure 2:
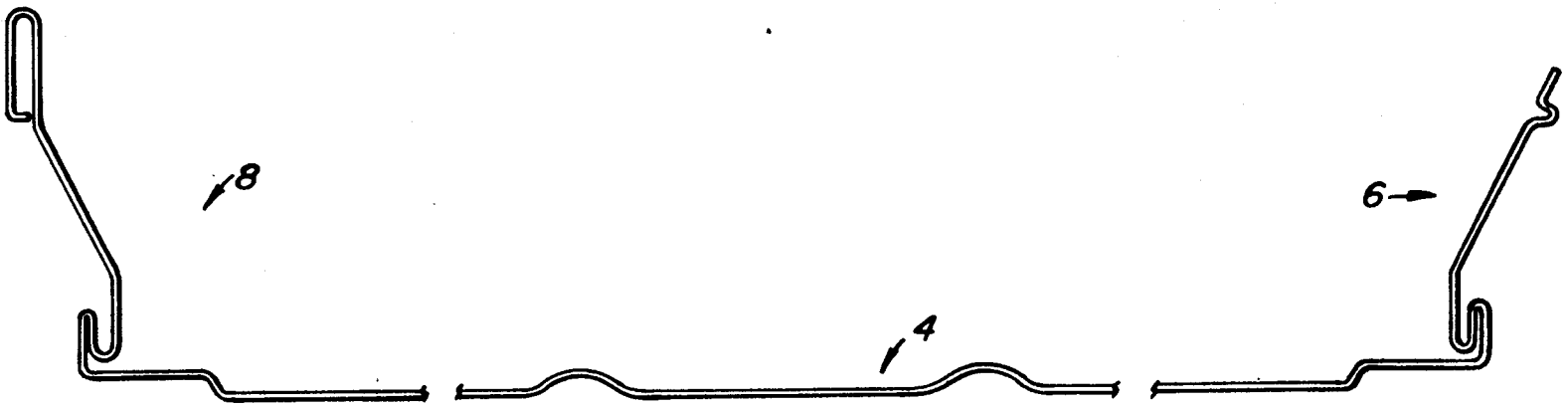
FIG. 2 is an end view of the pan of FIG. 1.

Referring the reader to FIGS. 1-3, a standing seam roofing/cladding system 2 is seen to include a number of panels 4 having first and second lateral edges 6, 8 coupled together by one or more channel brackets 10. The lengths and frequency of channel brackets 10 depends upon the load requirements at their particular parts of support structure 12 at which brackets are used. For example, longer brackets 10 may be used near ridges and eaves as opposed to midspan.

Panels 4 include offset portions 14, 16 at lateral edges 6, 8. Offset portions 14, 16 extend generally parallel to support surface 12. Lateral edges 6, 8 also include upwardly extending, that is away from support surface 12, bifold hems 18, 20 and first and second generally vertical legs 22, 24 extending from hems 18, 20. Legs 22, 24 include upper portions 26, 28 configured to form a clip-type standing seam 30. As shown in FIGS. 1 and 2, lip 32 of upper portion 24 engages a recessed portion 34 of upper portion 26 to form standing seam 30.

Channel bracket 10 includes a base 36 and first and second generally U-shaped arms 38, 40. Arms 38, 40 define downwardly opening cavities 42, 44 within which first and second hems 18, 20 are housed. Channel bracket 10 is relatively stiff and thus securely fastens the standing seam joint 45 to support structure 12 at the lower portions or bases of lateral edges 6, 8. Thus, if pans 4 are subjected to uplift forces, these forces are resisted by channel bracket 10 rather than by standing seam 30. Appropriate sealants are preferably used, such as at the engagement of lip 32 with recessed portion 34.

System 2 has been described with reference to a generally horizontal support structure 12. However, support structure 12 could be other than horizontal, such as vertical so that, as used in this application, the terms vertically, upwardly extending and similar terms are used for convenience but refer to directions away from the support structure.

In use, the user places two pans 4 with the first and second lateral edges 6, 8 adjacent one another. Upper portions 26, 28 of legs 22 are separated while the lower portions of the legs are restrained from separating to permit channel bracket 10 to be placed between the legs and engage hems 18, 20. Fasteners 46 are installed through holes 47 in bracket 10 to secure bracket 10, and edges 6, 8 therewith, to support structure 12. Lip 32 is engaged into recessed portion 34 by flexing upper portions 26, 28 to the right and the left relative to FIG. 1.

Figure 4:
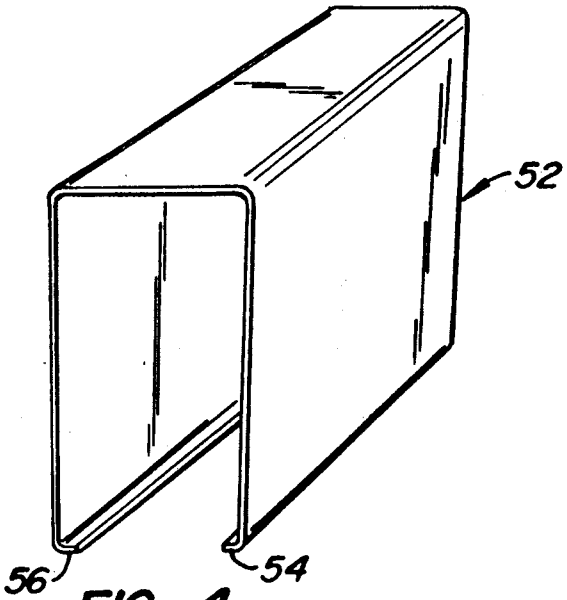
FIG. 4 is an oblique view of the batten shown in dash lines in FIG. 1.

Joint 45 is configured to provide spaces 48, 50 between offset portions 14 and 16 where legs 22, 24 join with hems 18, 20. A batten 52, shown in FIG. 4, can be mounted over standing seam joint 45 with the lower lips 54, 56 engaging within spaces 48, 50 as the batten is snapped into place. Batten 52 can be used for aesthetic and architectural reasons as well as for structural and functional reasons since the batten helps weatherproof standing seam 30 and helps to stiffen joint 46 for added strength.

Figure 7:
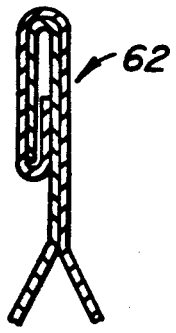
FIG. 7 is an end view of crimp type standing seam using the upper portions of the first and second legs shown in FIGS. 5 and 6.
Figure 5:
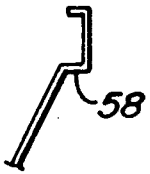
FIGS. 5 and 6 are end views of the upper portions of the first and second legs of the pan of FIG. 2 used to create a crimp type standing seam.
Figure 6:
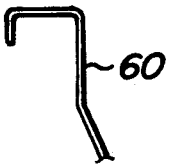

FIGS. 5 and 6 illustrate upper portions 58, 60 for an alternative embodiment of pan 4, the remainder of the pan being the same as pan 4 and thus not illustrated separately. Upper portions 58, 60 are used to create a crimp-type standing seam 62 shown in FIG. 7 as an alternative to the clip-type standing seam 30 of FIG. 2.

Other modifications and variation can be made to the disclosed embodiments without departing from the subject of the invention as defined in the following claims. For example, although pan 4 is preferably 20 gauge aluminum and bracket 18 is preferably 18 gauge stainless steel, they could be made of other materials, including plastics and other metals, as well.

What is claimed is:

1. A standing seam roofing/cladding system for mounting to a support structure comprising:

a plurality of elongate pans having first and second lateral edges;

a channel bracket, securable to the structure, including a base and first and second U-shaped arms defining first and second cavities opening towards the support structure;

the first and second lateral edges including first and second hems extending away from the support structure and first and second legs extending from the first and second hems away from the support structure at first and second positions respectively, the first and second hems being captured within the first and second cavities;

the first and second legs including first and second upper portions configured to engage one another to create a mechanically interlocked standing seam; and a batten cap including sides with lower ends and opposed lips at the lower ends sized and positioned to engage beneath the first and second positions to cover the standing seam.

* * * * *